United States Patent [19]

Kalsi

[11] Patent Number: 4,841,954

[45] Date of Patent: Jun. 27, 1989

[54] OCULOFACIAL MASSAGER

[75] Inventor: Nirmal S. Kalsi, Vancouver, Canada

[73] Assignee: KLASI, Nirmal S., Vancouver, Canada

[21] Appl. No.: 111,608

[22] Filed: Oct. 23, 1987

[30] Foreign Application Priority Data

Dec. 17, 1996 [CA] Canada ..... 525607

[51] Int. Cl.[4] ..... A61H 9/00

[52] U.S. Cl. ..... 128/36; 128/32

[58] Field of Search ..... 128/36, 32

[56] References Cited

U.S. PATENT DOCUMENTS

| | | | |
|---|---|---|---|
| 2,676,587 | 4/1954 | Corcoran | 128/1 A |
| 2,902,993 | 9/1959 | Wagner | 128/36 |
| 3,363,623 | 1/1968 | Atwell | 128/36 |
| 3,381,683 | 5/1968 | Runde | 128/63 |
| 3,636,945 | 1/1972 | Sato | 128/36 |
| 3,763,853 | 10/1973 | Jochimski | 128/36 |
| 3,811,430 | 5/1974 | Kawatami | 128/36 |
| 4,052,981 | 10/1977 | Bachmann | 128/36 |
| 4,469,092 | 9/1984 | Marshall et al. | 128/36 |
| 4,554,911 | 11/1985 | Nielsen | 128/57 |
| 4,574,787 | 3/1986 | Jacobs | 128/32 |
| 4,632,095 | 12/1986 | Libin | 128/60 |

*Primary Examiner*—Edgar S. Burr
*Assistant Examiner*—Kimberly L. Asher
*Attorney, Agent, or Firm*—John R. Uren

[57] ABSTRACT

An oculo-facial massager for simultaneously providing a massaging action to the eye, nose and temple areas. A contoured frame contacts the face of the user and a vibration generating device provides vibration to the frame which is transmitted to the facial muscles contacted by the frame.

12 Claims, 7 Drawing Sheets

OCULOFACIAL MASSAGER

INTRODUCTION

This invention relates to a facial massager and, more particularly, to a massager for use on the areas surrounding the nose, eyes and temples.

BACKGROUND OF THE INVENTION

Stress and tension of everyday activities cause particular problems in the areas of eyes, nose and temples. This stress and tension is increasing due to the widespread use of computer screens which have not previously been encountered until recent years. The facial muscles in the eye, nose and temple areas tighten which induce eye fatigue. Eye fatigue or eye discomfort can also be caused by long hours of reading, writing, driving, and lack of sleep and exercise. Such fatique and/or eye tension can result in eye discomfort, headaches and neck pain.

Massagers are known as relaxing and therapeutical devices. Previous massagers, however, utilize vibration generating means with an amplitude that is not conducive to gentle stimulation of the sensitive facial muscles around the eyes, nose and temples. Such units are usually larger and cannot be easily carried unobtrusively on the person. Such units further have no means to retain them on the body of the user and, in any event, such massagers are not designed for the purpose of simultaneous massaging of the facial muscles in the areas of the eyes, nose and temples.

SUMMARY OF THE INVENTION

In accordance with the invention, there is disclosed an oculo-facila massager for simultaneously massaging the nose and temple facial areas and the areas adjacent the eyes, nose and temples, said massager comprising frame means having an outer shell and an inner smooth substantially continuous cushioning material connected to said outer shell, said cushioning material being contoured so as to simultaneously and continuously contact the nose and temple facial areas and the areas adjacent the eyes, nose and temples of a user when in operation, vibration generating means connected to said frame means and retaining means for retaining said frame means adjacent to and in contact with the nose, the temples and the facial areas adjacent the eyes, nose and temples.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

Figure 1:
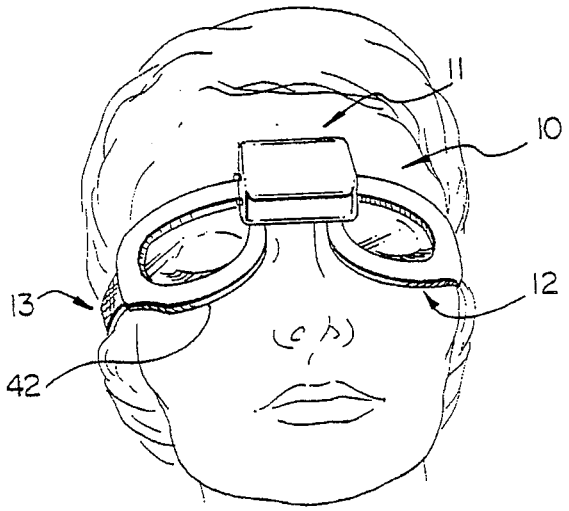
FIG. 1 illustrates the facial massager according to the invention in operating position on the face of the user.
Figure 2:
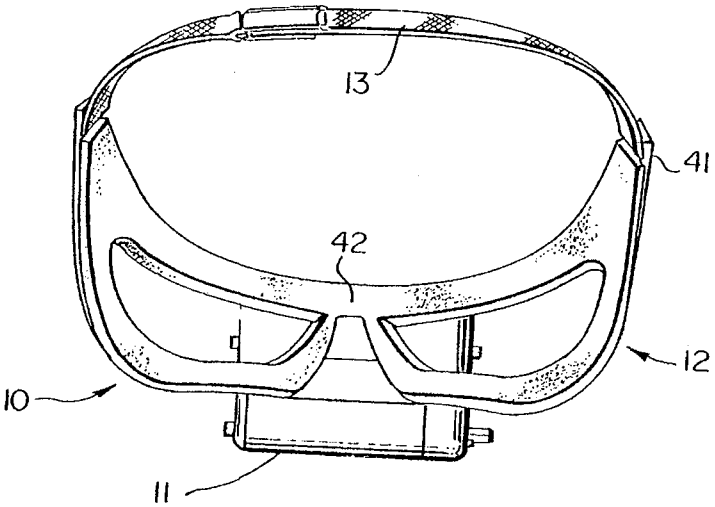
FIG. 2 is a rearwardly directed assembly isometric view of the facial massaging apparatus.

Referring now to the drawings, an oculo-facial muscle massager is shown generally at 10 in FIGS. 1 and 2. The massager 10 comprises a vibration generator or housing generally shown at 11, a support frame generally shown at 12 and a retaining means or elastic strap portion generally shown at 13 for retaining the support frame 12 and vibration generator 11 in operating position on a user (FIG. 1).

With reference to FIG. 2, the housing 11 is rigidly attached to the support frame 12 by means of adhesive using the location recesses 14 (FIG. 4) and the adjustable elastic strap portion 13 is connected to the support frame 12 by a pin 20 on each side of the frame 12 which extends through the ends 21 of the elastic strap portion 13.

Figure 3:
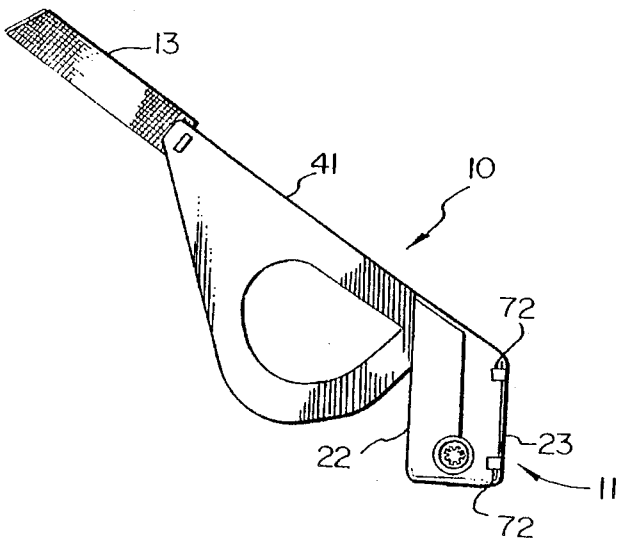
FIG. 3 is a side view of the apparatus of FIG. 2.

The housing 11 comprises inner and outer sections 22, 23, (FIG. 3) respectively, both made from an impact resistant and durable plastic such as ABS (Trademark). As more clearly seen in FIG. 5, the inner section 22 is illustrated separated from the outer section 23.

Figure 6:
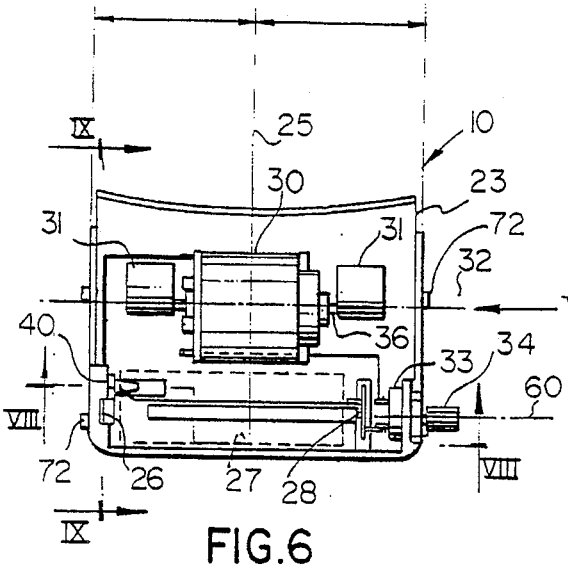
FIG. 6 is a view taken along VI in FIG. 5.
Figure 9:
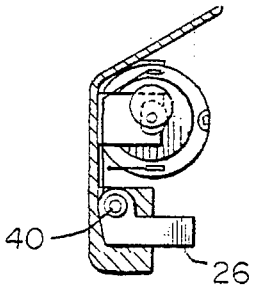
FIG. 9 is a sectional view taken along IX—IX of FIG. 6.

Referring to FIG. 6, the outer section 23 includes a motor 30 with weights 31 mounted to rotate eccentrically about axis 32. An on-off switch 33 is connected within the electrical circuit, which circuit includes the motor 30 connected to the on-off switch 33, and which motor is also connected to the source of power through the battery terminals 26 and 28 (FIGS. 6 and 9). A jack 40 is positioned to receive a plug (not shown) which may bring ordinary house voltage through an AC adapter or converter to the massager 10.

Figure 4:
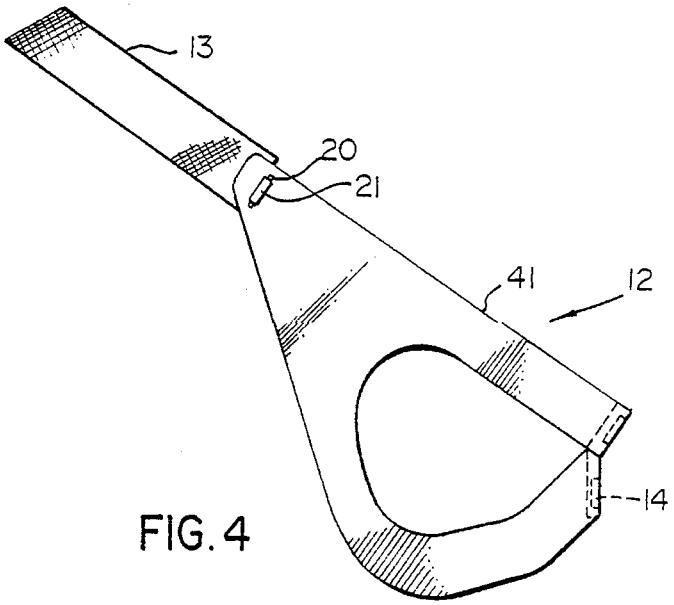
FIG. 4 is a side view similar to FIG. 3 but illustrating the frame of the massager separated from the housing of the vibration generator.
Figure 15:
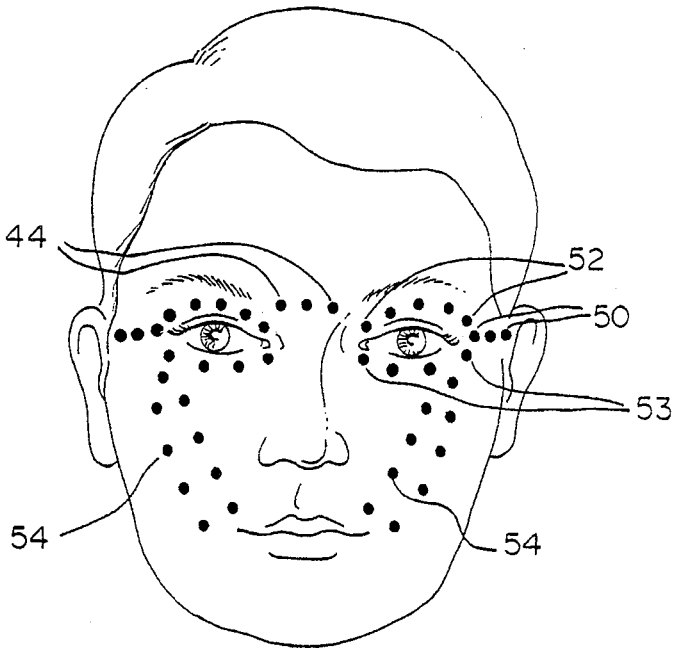
FIG. 15 is a full facial view illustrating the regions of interest affected by the massager.

The frame 12, more clearly seen in FIGS. 2 and 4, is made from a solid impact resistant plastic such as ABS (Trademark) as an outer protective layer 41 (FIG. 2). A soft foam rubber layer 42 is desirably mounted to the frame 12 and extends over the inner surface which is adapted to contact the user. The frame 12 is contoured together with the foam layer 42 to contact the user at the bridge of the nose which is the support position as seen in FIG. 1. The frame 12 is also contoured so as to simultaneously contact the facial contours of the user in the glabella, temple, supra-orbital, infra-orbital, and zygomatic regions 44, 50, 52, 53, 54 respectively as seen in FIG. 15. These regions also include the paranasal sinuses (not shown).

The adjustable elastic strap 13 extends around the head of the user and holds the oculo-facial massager 10 securely in place during operation.

OPERATION

In operation, the user will position the oculo-facial massager 10 in a comfortable position on the face as illustrated in FIG. 1 and will secure the massager 10 by properly tensioning and positioning the elastic strap 13 around the head. The AC adapter or converter (not shown) is plugged into the wall outlet. The power cord (not shown) from the AC adapter or converter extends to the plug end (not shown) and is inserted into the jack 40 (FIG. 6). The knob 34 of switch 33 is rotated about its axis 60 one-half turn to switch the motor 30 to the on-mode, the motor being operable to stop when the knob 34 is rotated a further one-half turn to its off-mode. The shaft 36 will rotate together with the weights 31 at the desired predetermined speed of revolution. It has been found that the speed of revolution for a comfortable and effective period of massage of approximately 6250 r.p.m.'s is suitable for a period of approximately 30 seconds to one minute.

Two techniques to use the massager 10 in its position on the face of the user have been found to be particularly beneficial. In the first technique, the massager 10 is worn as one would wear a pair of reading glasses with the adjustable elastic strap 13 encircling the head of the user. The user sits erect in a chair in which he can tilt his head back to contact the rearward or back portion of the chair. The switch 33 is switched on and the apparatus provides the gentle predetermined gyratory and percussive movement. This provides for appropriate relaxation and stimulation of the areas under and immediately adjacent to the massaged areas.

The second technique has been to lie on ones back on a cushion of thickness of about three inches such that the head may be tilted back to touch the floor. The oculo-facial massager 10 is then turned on for approximately one-half to one minute. It has been found that this posture may provide improved breathing, particularly when the sinus cavities are partially blocked as may be the case when a head cold is present. Such relief, however, is most certainly not promised nor is it the intent of the massager to provide such relief.

Figure 16:
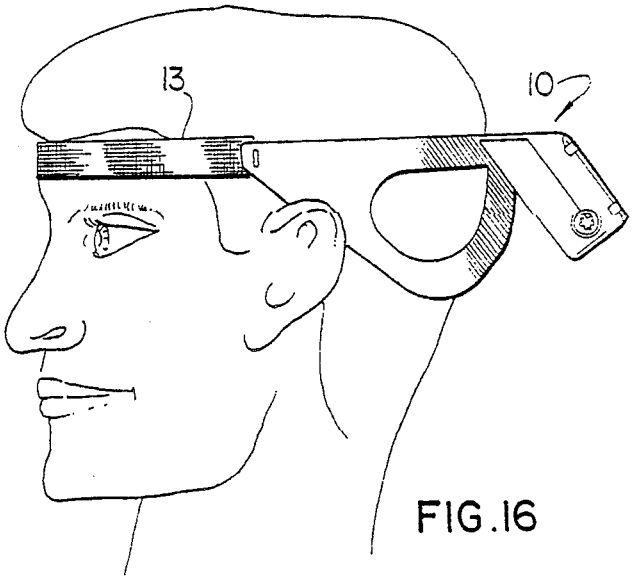
FIG. 16 is a side view illustrating the massager on the back of the head of a user.

The massager 10 can be worn, alternatively, at the back of the users head with the strap 13 holding the massager 10 in place by going around the user's forehead as illustrated in FIG. 16. This position of the massager has been found beneficial in inducing relaxation not only to the brain and head and neck muscles but also to the eyes particularly if the user is sensitive to the direct application of the massager 10 in the forward position.

Figure 17:
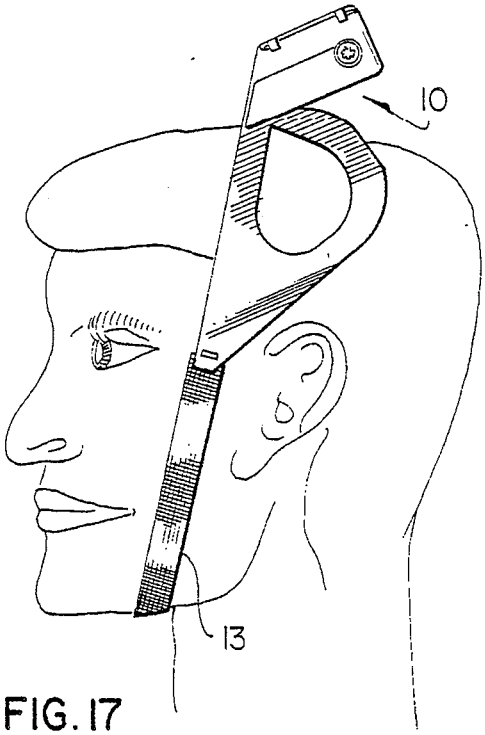
FIG. 17 is a side view illustrating the massager on the top of the head of a user.

A further position of the massager 10 is illustrated in FIG. 17. In this position, the massager 10 is worn on the top of the head so that the strap 13 goes under the chin of the user. This application of the massager 10 in this position has been found beneficial in inducing a feeling of relaxation which is transmitted throughout the body.

Figure 7:
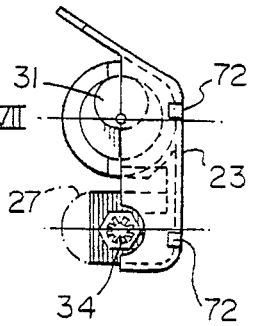
FIG. 7 is a side view taken along VII in FIG. 6.
Figure 8:
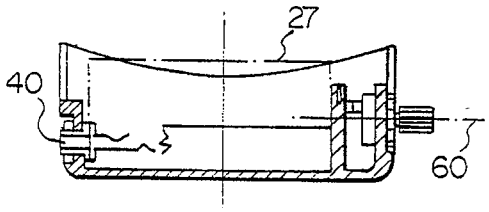
FIG. 8 is a sectional view taken along VIII—VIII of FIG. 6.
Figure 13:
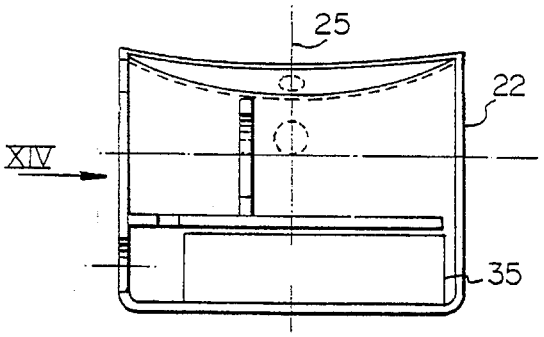
FIG. 13 is a view of the massager taken along XIII of FIG. 5.
Figure 14:
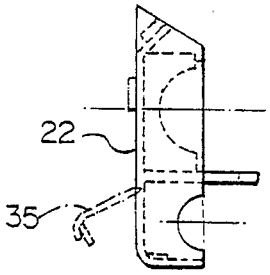
FIG. 14 is a side view taken along XIV of FIG. 13.
Figure 11:
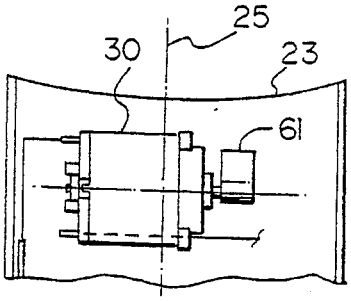
FIG. 11 illustrates a second embodiment of the vibration generating apparatus in a view similar to that of FIG. 6.
Figure 12:
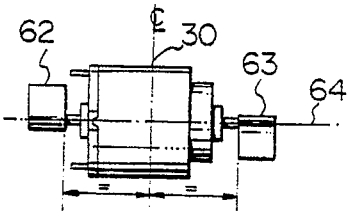
FIG. 12 is a view illustrating a third embodiment of the vibration generating apparatus separated from the housing.

Many other embodiments of the apparatus are envisioned. The dual weights which are offset the same amount on the same side of the axis 32 as illustrated in FIG. 6 can be replaced with a single offset weight 61 as illustrated in FIG. 11 in which case the motor 30 is shifted in the outer section 23 relative to the axis 25 in order to produce a balanced vibratory action. Alternatively, a pair of offset weights 62 and 63 (FIG. 12) positioned on opposite side of the axis 64 can be utilized as illustrated in FIG. 6. Such different weight configurations simply determine the most satisfactory combination of gyratory and percussive movements created by the motor operation. The embodiment specifically described utilizes house voltage applied to an AC adapter or converter and a motor designed to run from such adapter. Alternatively, a battery source 27 could be used if desired by the user. Such a battery is shown in phantom in FIGS. 6 and 7 which battery is self-contained within the unit and which could be rechargeable if desired either from its location within the housing 11 where a plug can be inserted into jack 40 or at a remote location. A battery cover 35 (FIGS. 13 and 14) may be used to expose a battery (not shown) and to allow for its removal either for replacement or for recharging.

The frame 12 with its attached foam layer 42 (FIG. 2) is adapted to contact the facial muscles in the eyes, nose and temples regions simultaneously. Because of the shapes of various user faces, however, it may be desirable to have a pliable frame which could be contoured by the user to fit more closely to the desired regions. Likewise, while the vibration generator housing 11 is shown as being attached to the frame 12 at that location closest to the bridge of the nose, the vibration generating means could be mounted at any other convenient location or, indeed, the vibration generating means could be located remote from the frame and the vibration would be transmitted to the frame such as would be the case, for example, in a water pulse apparatus. The only requirement is that the vibration be transmitted uniformly to the frame 12 and, thence, to the user.

Figure 5:
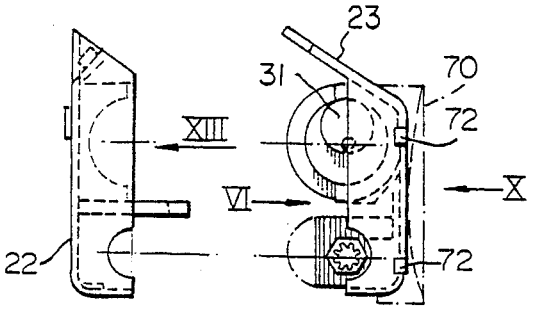
FIG. 5 is an exploded view of the vibration generator housing.
Figure 10:
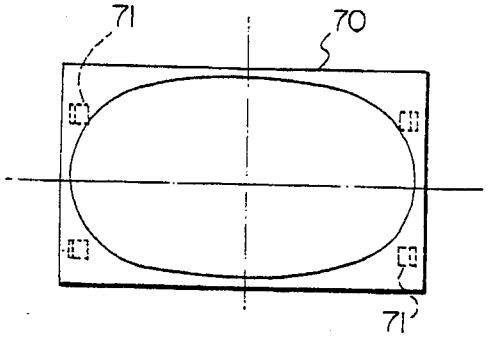
FIG. 10 is a view taken along X of FIG. 5.

A rubber pad 70 is illustrated in ghost in FIG. 5 and in its entirety in FIG. 10. Such a pad 70 is removeable from the outer section 23 of the housing 11 by using appropriate resilient clips 71 (FIG. 10) which are received by complimentary plugs 72 (FIG. 5) on the outer housing 23. The use of the cushioning pad 70 allows the appartus to be used as a hand held massager and such use makes the unit more versatile. The cushioning pad 70 is contoured as illustrated.

While a revolution rate of the shaft 36 of the motor 30 of 6250 r.p.m.'s has been found satisfying, a user may well desire a revolution rate greater or less than this figure. Such a revolution rate may be obtained either by the use of a rheostat or the motor may be designed to operate at the different rate with the use of the on-off switch.

Many other modifications to the invention may readily be contemplated in addition to the specific embodiment described and such embodiments should be considered illustrative only and not as limiting the scope of the invention as defined in accordance with the accompanying claims.

I claim:

1. An oculo-facial massager for simultaneously massaging the nose and temple facial areas and the areas adjacent the eyes, nose and temples, said massager comprising frame means having an outer shell and an inner smooth substantially continuous cushioning material connected to said outer shell, said cushioning material being contoured so as to simultaneously and continuously contact the nose and temple facial areas and the areas adjacent the eyes, nose and temples of a user when in operation, vibration generating means connected to said frame means and retaining means for retaining said frame means adjacent to and in contact with the nose, the temples and the facial areas adjacent the eyes, nose and temples.

2. An oculo-facial massager as in claim 1 and further including switch means to commence and terminate operation of said vibration means.

3. An oculo-facial massager as in claim 1 wherein said retaining means is an adjustable elastomeric member connected to said frame means and operable to encircle the head of the user.

4. An oculo-facial massager as in claim 1 wherein said vibration generating means is a motor with at least one eccentric weight rotatable about an axis, said weight being offset along said axis adjacent the longitudinal centre line of said frame.

5. An oculo-facial massager as in claim 1 wherein said frame means is pliable.

6. An oculo-facial massager as in claim 1 and further comprising adjustment means to increase or decrease the frequency of said vibration generating means.

7. An oculo-facial massager as in claim 6 wherein said adjustment means is a rheostat.

8. An oculo-facial massager as in claim 1 wherein said frame means comprises an elastic structure.

9. An oculo-facial massager in claim 1 wherein said vibration generating means is attached directly to said frame.

10. An oculo-facial massager as in claim 1 or 9 wherein said vibration generating means is a motor with two eccentrically mounted weights operatively connected to said motor for rotation about a longitudinal axis, said weights being located adjacent each end of said motor, substantially equidistant from the longitudinal centre line of said frame.

11. An oculo-facial massager as in claim 1 and further comprising a cushioning pad mounted on the vibration generating means.

12. An oculo-facial massager as in claim 1 wherein said frame means is contoured and operable to fit the head of a user, said retaining means being operable to retain said frame means adjacent to and in contact with at least one area of said head other than said facial areas adjacent to the eyes, nose and temples.

* * * * *

UNITED STATES PATENT AND TRADEMARK OFFICE

CERTIFICATE OF CORRECTION

PATENT NO. : 4,841,954

DATED : June 27, 1989

INVENTOR(S) : Kalsi, Nirmal S. et al

It is certified that error appears in the above-identified patent and that said Letters Patent is hereby corrected as shown below:

On the title page:

In the Inventor Identification [19] and [75], change "Nirmal S. Kalsi" to --Nirmal S. Kalsi et al--

In item [75] add --Harjeet S. Kalsi--.

In the Assignee Identification (Section 73), change "KLASI," to --KALSI,--

In the priority data identification (Section 30), change Dec. 17, 1996" to --Dec. 17, 1986--

Column 1, line 19; change "fatique" to --fatigue--

Column 1, line 36; change "oculo-facila" to --oculo-facial--

Signed and Sealed this

Second Day of July, 1991

*Attest:*

HARRY F. MANBECK, JR.

*Attesting Officer*

*Commissioner of Patents and Trademarks*